US010559198B1

(12) United States Patent
Price et al.

(10) Patent No.: US 10,559,198 B1
(45) Date of Patent: Feb. 11, 2020

(54) SYSTEM AND METHOD OF ADAPTIVE CONTROLLING OF TRAFFIC USING ZONE BASED OCCUPANCY

(71) Applicant: Cubic Corporation, San Diego, CA (US)

(72) Inventors: Jeffery R. Price, Knoxville, TN (US); Timothy F. Gee, Oak Ridge, TN (US)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 16/058,343

(22) Filed: Aug. 8, 2018

(51) Int. Cl.
*G08G 1/07* (2006.01)
*G08G 1/01* (2006.01)
*G08G 1/04* (2006.01)

(52) U.S. Cl.
CPC ..... *G08G 1/0145* (2013.01); *G08G 1/0116* (2013.01); *G08G 1/04* (2013.01)

(58) Field of Classification Search
None
See application file for complete search history.

(56) References Cited

U.S. PATENT DOCUMENTS

| | | | |
|---|---|---|---|
| 4,833,469 A | 5/1989 | David | |
| 5,111,401 A | 5/1992 | Everett et al. | |
| 5,208,584 A | 5/1993 | Kaye et al. | |
| 5,406,490 A | 4/1995 | Braegas | |
| 5,444,442 A | 8/1995 | Sadakata et al. | |
| 6,064,139 A | 5/2000 | Ozawa et al. | |
| 6,075,874 A | 6/2000 | Higashikubo et al. | |
| 6,317,058 B1 | 11/2001 | Lemelson et al. | |
| 6,366,219 B1 * | 4/2002 | Hoummady | G08G 1/04 340/907 |

(Continued)

FOREIGN PATENT DOCUMENTS

| | | |
|---|---|---|
| CN | 100533151 | 8/2009 |
| CN | 101799987 | 8/2010 |

(Continued)

OTHER PUBLICATIONS

Dehghan et al., Afshin; "Automatic Detection and Tracking of Pedestrians in Videos with Various Crowd Densities", Pedestrian and Evacuation Dynamics 2012.

(Continued)

*Primary Examiner* — Julie B Lieu
(74) *Attorney, Agent, or Firm* — Kilpatrick Townsend & Stockton LLP

(57) ABSTRACT

Systems and methods for triggering changes to traffic signals based on the number and/or types of vehicles occupying a detection zone are disclosed. One aspect of the present disclosure includes a device with memory having computer-readable instructions stored therein and one or more processors. The one or more processors are configured to execute the computer-readable instructions to receive identification of zones and corresponding traffic light rules for a traffic intersection; and for each identified zone, detect a number of objects in the zone; based at least in part on the number of objects detected in the zone, determine if a corresponding condition is met; and upon determining that the corresponding condition is met for the zone, send a corresponding output signal to a traffic signal controller to change a traffic signal for the zone.

15 Claims, 7 Drawing Sheets

(56) References Cited

U.S. PATENT DOCUMENTS

| | | | | |
|---|---|---|---|---|
| 6,405,132 | B1 | 6/2002 | Breed et al. | |
| 6,505,046 | B1 | 1/2003 | Baker | |
| 6,526,352 | B1 | 2/2003 | Breed et al. | |
| 6,720,920 | B2 | 4/2004 | Breed et al. | |
| 6,741,926 | B1 | 5/2004 | Zhao et al. | |
| 6,751,552 | B1 | 6/2004 | Minelli | |
| 6,768,944 | B2 | 7/2004 | Breed et al. | |
| 6,862,524 | B1 | 3/2005 | Nagda et al. | |
| 6,937,161 | B2 | 8/2005 | Nishimura | |
| 7,110,880 | B2 | 9/2006 | Breed et al. | |
| 7,610,146 | B2 | 10/2009 | Breed | |
| 7,630,806 | B2 | 12/2009 | Breed | |
| 7,698,055 | B2 | 4/2010 | Horvitz et al. | |
| 7,698,062 | B1 | 4/2010 | McMullen et al. | |
| 7,821,421 | B2 | 10/2010 | Tamir et al. | |
| 7,835,859 | B2 | 11/2010 | Bill | |
| 7,899,611 | B2 | 3/2011 | Downs et al. | |
| 7,979,172 | B2 | 7/2011 | Breed | |
| 8,050,863 | B2 | 11/2011 | Trepagnier et al. | |
| 8,135,505 | B2 | 3/2012 | Vengroff et al. | |
| 8,144,947 | B2 | 3/2012 | Kletter | |
| 8,212,688 | B2 | 7/2012 | Morioka et al. | |
| 8,255,144 | B2 | 8/2012 | Breed et al. | |
| 8,373,582 | B2 | 2/2013 | Hoffberg | |
| 8,566,029 | B1 | 10/2013 | Lopatenko et al. | |
| 8,589,069 | B1 | 11/2013 | Lehman | |
| 8,682,812 | B1 | 3/2014 | Ran | |
| 8,706,394 | B2 | 4/2014 | Trepagnier et al. | |
| 8,825,350 | B1 * | 9/2014 | Robinson | G08G 1/0116 701/117 |
| 8,903,128 | B2 | 12/2014 | Shet et al. | |
| 9,043,143 | B2 | 5/2015 | Han | |
| 9,387,928 | B1 | 7/2016 | Gentry et al. | |
| 9,965,951 | B1 * | 5/2018 | Gallagher | G08G 1/0145 |
| 2004/0155811 | A1 | 8/2004 | Albero et al. | |
| 2005/0187708 | A1 | 8/2005 | Joe et al. | |
| 2007/0162372 | A1 | 7/2007 | Anas | |
| 2007/0208494 | A1 | 9/2007 | Chapman et al. | |
| 2007/0273552 | A1 * | 11/2007 | Tischer | G08G 1/01 340/910 |
| 2008/0094250 | A1 * | 4/2008 | Myr | G08G 1/04 340/909 |
| 2008/0195257 | A1 | 8/2008 | Rauch | |
| 2009/0048750 | A1 | 2/2009 | Breed | |
| 2009/0051568 | A1 | 2/2009 | Corry et al. | |
| 2011/0001635 | A1 * | 1/2011 | Akens | G08G 1/04 340/936 |
| 2011/0037618 | A1 * | 2/2011 | Ginsberg | G08G 1/096775 340/905 |
| 2011/0205086 | A1 * | 8/2011 | Lamprecht | G08G 1/08 340/928 |
| 2012/0038490 | A1 | 2/2012 | Verfuerth | |
| 2012/0112928 | A1 | 5/2012 | Nishimura et al. | |
| 2014/0136414 | A1 | 5/2014 | Abhyanker | |
| 2014/0277986 | A1 | 9/2014 | Mahler et al. | |
| 2017/0169309 | A1 | 6/2017 | Reddy et al. | |
| 2018/0075739 | A1 * | 3/2018 | Ginsberg | B60K 35/00 |
| 2019/0049264 | A1 | 2/2019 | Malkes | |
| 2019/0050647 | A1 | 2/2019 | Malkes | |
| 2019/0051152 | A1 | 2/2019 | Malkes | |
| 2019/0051160 | A1 | 2/2019 | Malkes | |
| 2019/0051161 | A1 | 2/2019 | Malkes | |
| 2019/0051162 | A1 | 2/2019 | Malkes | |
| 2019/0051163 | A1 | 2/2019 | Malkes | |
| 2019/0051164 | A1 | 2/2019 | Malkes | |
| 2019/0051167 | A1 | 2/2019 | Malkes | |
| 2019/0051171 | A1 | 2/2019 | Malkes | |

FOREIGN PATENT DOCUMENTS

| | | |
|---|---|---|
| CN | 101944295 | 1/2011 |
| EP | 0 464 821 | 1/1992 |
| KR | 2013-0067847 | 6/2013 |

OTHER PUBLICATIONS

Dubska et al.; "Automatic Camera Calibration for Traffic Understanding", bmva.org, 2014.

Grosser, Kari; "Smart Io T Technologies for Adaptive Traffic Management Using A Wireless Mes Sensor Network", Advantech Industrial Io T Blog, Feb. 3, 2017.

https://www.flir.com, 2018.

Halper, Mark; Smart Cameras Will Help Spokane Light It's World More Intelligently (Updated), LEDs Magazine, and Business/Energy/Technology Journalist, Apr. 19, 2017.

Heaton, Brian; "Smart Traffic Signals Get a Green Light", Government Technology Magazine, Feb. 15, 2012.

Kolodny, Lora; Luminar reveals sensors that could make self-driving cars safer than human, Techcrunch, Apr. 13, 2017.

McDermott, John; "Google's newest secret weaon for local ads", Digiday, Jan. 29, 2014.

Resnick, Jim; "How Smart Traffic Signals May Ease Your Commute", BBC, Autos, Mar. 18, 2015.

Sun et al., M.; "Relating Things and Stuff Via Object Property Interactions", cvgl.stanford.edu, Sep. 4, 2012.

Whitwam, Ryan; "How Google's self-driving cars detect and avoid obstacles", ExtremeTech, Sep. 8, 2014.

Yamaguchi, Jun'ichi; "Three Dimensional Measurement Using Fisheye Stereo Vision", Advances in Theory and Applications of Stereo Vision, Dr. Asim Bhatti (Ed.), ISBN:978-953-307-516-7, InTech. Jan. 8, 2011.

U.S. Appl. No. 16/030,396 Office Action dated Nov. 20, 2018.

U.S. Appl. No. 16/030,396, William A. Malkes, System and Method Adaptive Controlling of Traffic Using Camera Data, filed Jul. 9, 2018.

U.S. Appl. No. 16/044,891, William A. Malkes, System and Method for Controlling Vehicular Traffic, filed Jul. 25, 2018.

U.S. Appl. No. 16/032,886, William A. Malkes, Adaptive Traffic Control Using Object Tracking and Identity Details, filed Jul. 11, 2018.

U.S. Appl. No. 16/058,106, William A. Malkes, System and Method for Managing Traffic by Providing Recommendations to Connected Objects, filed Aug. 8, 2018.

U.S. Appl. No. 16/059,814, William A. Malkes, Systems and Methods of Navigating Vehicles, filed Aug. 9, 2018.

U.S. Appl. No. 16/059,886, William A. Malkes, System and Method of Adaptive Traffic Optimization Using Unmanned Aerial Vehicles, filed Aug. 9, 2018.

U.S. Appl. No. 16/058,214, William A. Malkes, System and Method of Adaptive Traffic Management at an Intersection, filed Aug. 8, 2018.

U.S. Appl. No. 16/100,750, William A. Malkes, System and Method of Adaptive Traffic Management at an Intersection, filed Aug. 10, 2018.

U.S. Appl. No. 16/101,766, William A. Malkes, System and Method for Retail Revenue Based Traffic Management, filed Aug. 13, 2018.

U.S. Appl. No. 16/101,933, William A. Malkes, Adaptive Optimization of Navigational Routes Using Traffic Data, filed Aug. 13, 2018.

* cited by examiner

SYSTEM AND METHOD OF ADAPTIVE CONTROLLING OF TRAFFIC USING ZONE BASED OCCUPANCY

FIELD OF THE DISCLOSURE

The present disclosure is generally related to traffic control systems, and more particularly related to triggering changes of traffic signals based on the number and/or types of vehicles in a detection zone.

BACKGROUND

Traffic control systems regulate the flow of traffic through intersections. Generally, traffic signals, comprising different color and/or shapes of lights, are mounted on poles or span wires at the intersection. These traffic signals are used to regulate the movement of traffic through the intersection by turning on and off their different signal lights. These signals, together with the equipment that turns on and off their different lights, comprise a traffic control system. The change in the color of lightings is typically performed according to a pre-set traffic control settings that specify duration of each color at one or more entry/exit points at an intersection.

With advancements in traffic control systems, some of these systems utilize inductive loops installed at one or more locations at the intersection to detect the presence of a vehicle and actuate the light changes. For example, if a vehicle is detected stopping at a red light at an intersection in one direction while no other car is detected as traveling through other entry/exit points of the intersection with a green light, the traffic control system can switch the green light to red while turning the red light for the stopped vehicle to green in order to allow the stopped vehicle to proceed through the intersection.

Utilization of such inductive loops are costly and require manual modification to road surfaces at the intersection. Furthermore, their accuracy can degrade over time and due to varying environmental conditions. Lastly, these inductive loops cannot differentiate the number and/or types of vehicles activating them. For example, if at a given point in time 3 vehicles are stopped on one side of the intersection and 8 vehicles at another, standard inductive loops do not trigger a change in the lighting pattern in favor of the 8 vehicles.

SUMMARY

One or more example embodiments of inventive concepts are directed to providing adaptive traffic control mechanisms at an intersection (or a group of intersections in vicinity of each other) based on zone-based detection of the number of objects present at the intersection.

One aspect of the present disclosure includes a device with memory having computer-readable instructions stored therein and one or more processors. The one or more processors are configured to execute the computer-readable instructions to receive identification of zones and corresponding zone rules; and for each identified zone, detect a number of objects in the zone; based at least in part on the number of objects detected in the zone, determine if a corresponding condition is met according to the zone rules; and upon determining that the corresponding condition is met for the zone, send a corresponding signal to a traffic signal controller to change the traffic signal for the zone.

One aspect of the present disclosure includes one or more computer-readable medium have computer-readable instructions stored thereon, which when executed by one or more processors, cause the one or more processors to receive identification of zones and corresponding zone rules; and for each identified zone, detect a number of objects in the zone; based at least in part on the number of objects detected in the zone, determine if a corresponding condition is met according to the zone rules; and upon determining that the corresponding condition is met for the zone, send a corresponding signal to a traffic signal controller to change a traffic signal for the zone.

One aspect of the present disclosure includes a method of zone-based traffic control. The method includes receiving identification of zones and corresponding zone rules; and for each identified zone, detecting a number of objects in the zone; based at least in part on the number of objects detected in the zone, determining if a corresponding condition is met according to the zone rules; and upon determining that the corresponding condition is met for the zone, send a corresponding signal to a traffic signal controller to change a traffic signal for the zone.

BRIEF DESCRIPTION OF THE DRAWINGS

The accompanying drawings illustrate various example embodiments of systems, methods, and example embodiments of various other aspects of the disclosure. Any person with ordinary skills in the art will appreciate that the illustrated element boundaries (e.g. boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Specific details are provided in the following description to provide a thorough understanding of embodiments. However, it will be understood by one of ordinary skill in the art that embodiments may be practiced without these specific details. For example, systems may be shown in block diagrams so as not to obscure the embodiments in unnecessary detail. In other instances, well-known processes, structures and techniques may be shown without unnecessary detail in order to avoid obscuring embodiments.

Although a flow chart may describe the operations as a sequential process, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

Example embodiments of the present disclosure will be described more fully hereinafter with reference to the accompanying drawings in which like numerals represent like elements throughout the several figures, and in which example embodiments are shown. Example embodiments of the claims may, however, be embodied in many different forms and should not be construed as limited to the example embodiments set forth herein. The examples set forth herein are non-limiting examples and are merely examples among other possible examples.

Figure 1:
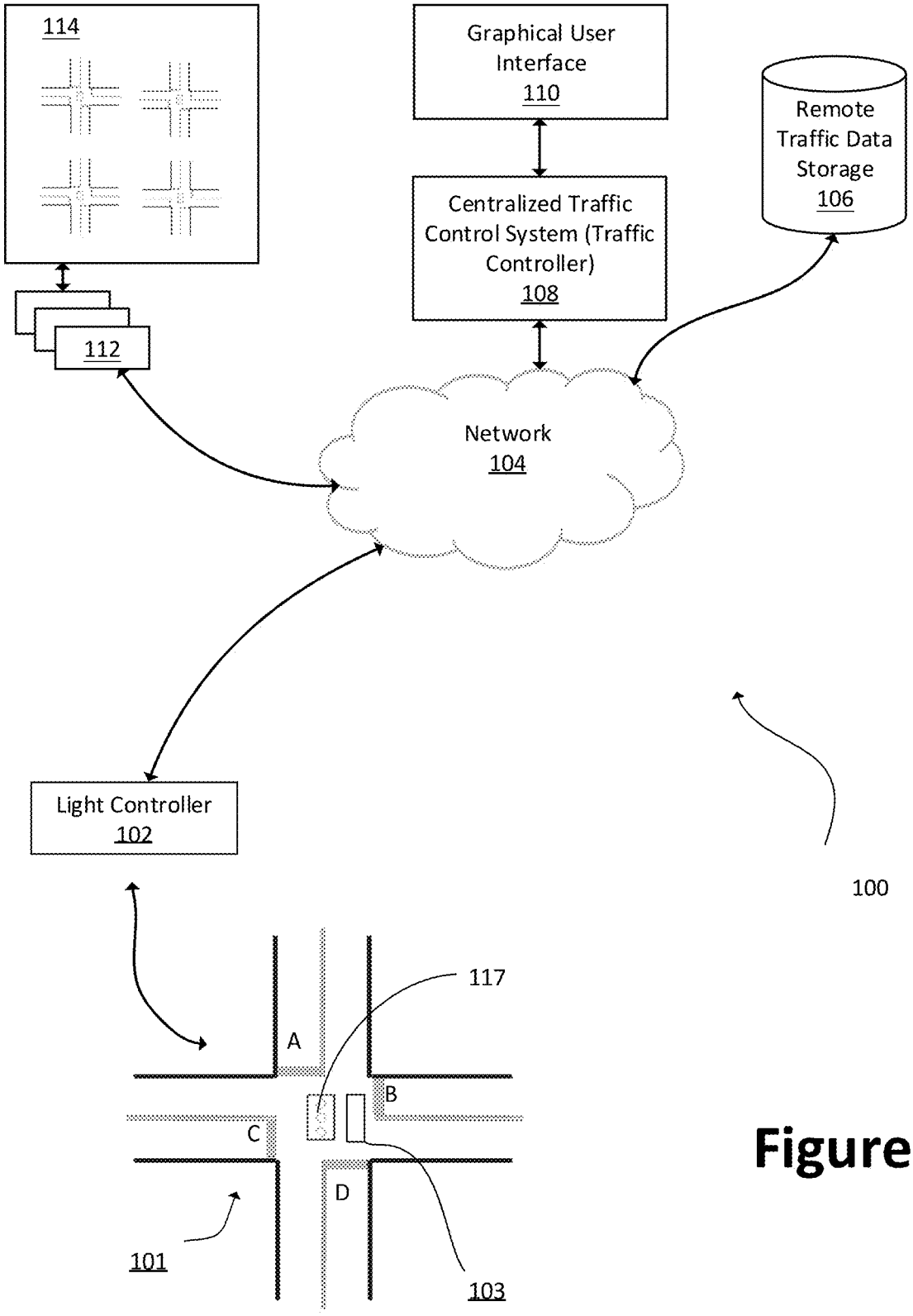
FIG. 1 illustrates a system for controlling traffic.

FIG. 1 illustrates a system for controlling traffic. The system 100 can include various components such as, but not limited to, a traffic light controller 102 (hereinafter may be referred to as a light controller 102) associated with a smart traffic camera 103 and traffic light 117 installed at an intersection 101 (intersection 101 may be referred to as a signalized intersection 101 or a signalized roadway). Components of the light controller 102 will be further described with reference to FIG. 2. The light controller 102 may or may not be physically located near the smart traffic camera 103 or the traffic light 117. There may be more than one smart traffic camera 103 and/or traffic light 117 installed at intersection 101. The smart traffic camera 103 may be one of various types of cameras including, but not limited to, fisheye traffic cameras to detect and optimize traffic flows at the intersection 101 and/or at other intersections part of the same local network or corridor. The smart traffic camera 103 can be any combination of cameras or optical sensors, such as but not limited to fish-eye cameras, directional cameras, infrared cameras, etc. The smart traffic camera 103 can allow for other types of sensors (e.g., audio sensors, temperature sensors, etc.) to be connected thereto (e.g., via various known or to be developed wired and/or wireless communication schemes) for additional data collection. The smart traffic camera 103 can collect video and other sensor data at the intersection 101 and convey the same to the light controller 102 for further processing, as will be described below.

The system 100 may further include network 104. The network 104 can enable the light controller 102 (which may also be referred to as the traffic signal controller 102) to communicate with remote system components including, but not limited to, a remote traffic data storage 106, a centralized traffic control system 108 and/or other light control systems 112 controlling traffic at one or more adjacent/nearby/additional intersections such as intersections 114.

The network 104 can be any known or to be developed cellular, wireless access network, or local area network that enables communication (wired or wireless) among components of the system 100.

The remote traffic data storage 106 or simply the remote storage 106 can store therein, for a given intersection such as the intersection 101, various types of data and statistics about traffic patterns and conditions. Furthermore, the remote storage 106 can have stored thereon dynamic rules, settings and parameters for controlling traffic at the intersection 101, as determined by the centralized traffic control system 108. Such rules, settings and parameters can be fetched or retrieved by the light controller 102 for implementation at the traffic light 117.

The centralized traffic control system 108 (or traffic controller 108) can provide a centralized platform for network operators to view and manage traffic conditions, set traffic control parameters and/or manually override any traffic control mechanisms at any given intersection. An operator can access and use the centralized traffic control system 108 via a corresponding graphical user interface 110 after providing logging credentials and authentication of the same by the centralized traffic control system 108.

Furthermore, the centralized traffic control system 108 can have various algorithms and computer-readable programs such as known or to be developed machine learning algorithms to accept as input various statistics regarding traffic patterns and conditions at the intersection 101 and in response thereto generate adaptive control parameters and rules (e.g., using known or to be developed machine learning algorithms) to be implemented by the light controller 102.

In one example, the remote traffic data storage 106 and the centralized traffic control system 108 may be services implemented on a public, private or a hybrid of public and private cloud-based platforms provided by a cloud service provider.

While certain components have been shown and described with reference to FIGS. 2 and 3, the components of the light controller 102 and/or the traffic control system 108 are not limited thereto, and can include any other component for proper operations thereof, including, but not limited to, a transceiver, a power source, etc.

The light controllers 112 can be associated with one or more traffic lights at one or more of the intersections 114 and can function in a similar manner as the light controller 102. Alternatively, any one of the light controllers 112 can be a conventional light controller implementing pre-set traffic control settings at the corresponding traffic lights but configured to convey corresponding traffic statistics to the centralized traffic control system 108.

The intersections 114 can be any number of intersections adjacent to the intersection 101, within the same neighborhood or city as the intersection 101, intersections in another city, etc.

In one or more examples, the light controller 102 and the traffic control system 108 can be the same (one component implementing the functionalities of both). In such examples, components described below with reference to FIGS. 2 and 3 may be combined into 1. Furthermore, in such examples, the light controller 102 may be remotely located relative to the smart traffic camera 103 and the traffic light 117 and be communicatively coupled thereto over a communication network.

As mentioned above, the components of the system 100 can communicate with one another using any known or to be developed wired and/or wireless network. For example, for wireless communication, techniques such as Visible Light Communication (VLC), Worldwide Interoperability for Microwave Access (WiMAX), Long Term Evolution (LTE), Fifth Generation (5G) Cellular, Wireless Local Area Network (WLAN), Infrared (IR) communication, Public Switched Telephone Network (PSTN), Radio waves, and other communication techniques known or to be developed in the art may be utilized.

While certain components of the system 100 are illustrated in FIG. 1, inventive concepts are not limited thereto and the system 100 may include any number of additional components necessary for operation and functionality thereof.

Having described an example of a system for controlling traffic, the disclosure now turns to description of components of the light controller 102.

Figure 2:
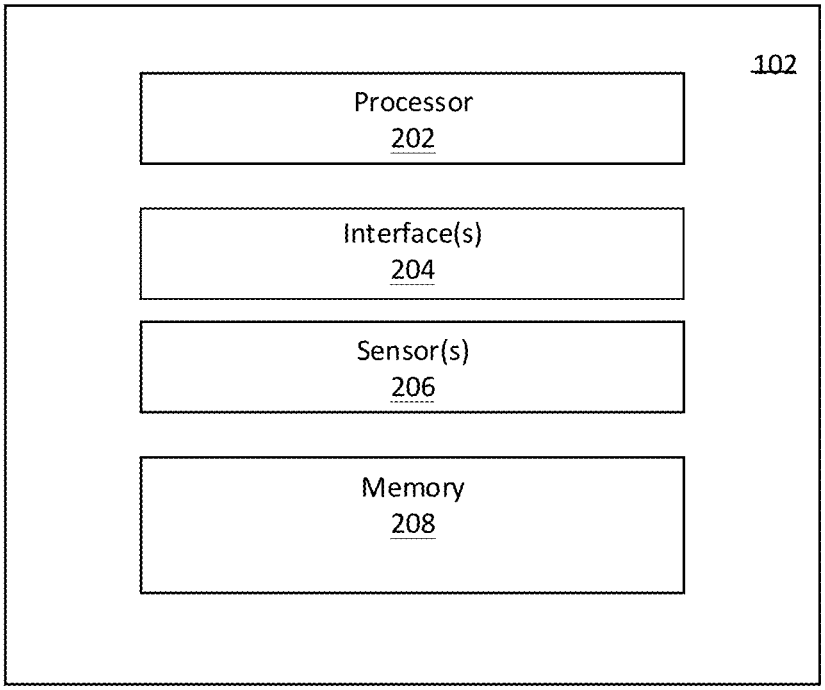
FIG. 2 illustrates a block diagram showing different components of a light controller of the system of FIG. 1.

FIG. 2 illustrates a block diagram showing different components of a traffic control unit of the system of FIG. 1. As mentioned above, the light controller 102 can be physically located near the smart traffic camera 103 and/or the traffic light 117 (e.g., at a corner of the intersection 101) or alternatively can communicate with the smart traffic camera 103 and/or the traffic light 117 wirelessly or via a wired communication scheme (be communicatively coupled thereto).

The light controller 102 can comprise one or more processors such as a processor 202, interface(s) 204, sensor(s) 206, and one or more memories such as a memory 208. The processor 202 may execute an algorithm stored in the memory 208 for zone-based traffic controlling, as will be described below. The processor 202 may also be configured to decode and execute any instructions received from one or more other electronic devices or server(s). The processor 202 may include one or more general purpose processors (e.g., INTEL® or Advanced Micro Devices® (AMD) microprocessors, ARM) and/or one or more special purpose processors (e.g., digital signal processors, Xilinx® System On Chip (SOC) Field Programmable Gate Array (FPGA) processor, and/or Graphics Processing Units (GPUs)). The processor 202 may be configured to execute one or more computer-readable program instructions, such as program instructions to carry out any of the functions described in this description.

The interface(s) 204 may assist an operator in interacting with the light controller 102. The interface(s) 204 of the light controller 102 may be used instead of or in addition to the graphical user interface 110 that is centrally accessible by operators or may be the same as the graphical user interface 110. The interface(s) 204 either accept an input from the operator or provide an output to the operator, or may perform both the actions. The interface(s) 204 may either be a Command Line Interface (CLI), Graphical User Interface (GUI), voice interface, and/or any other user interface known in the art or to be developed.

The sensor(s) 206 can be one or more smart cameras such as fish-eye cameras mentioned above or any other type of sensor/capturing device that can capture various types of data (e.g., audio/visual data) regarding activities and traffic patterns at the intersection 101. Any one such sensor 206 can be located at/attached to the light controller 102, located at/attached to the smart traffic camera 103 and/or the traffic light 117 or remotely installed from and communicatively coupled thereto.

In one example embodiment, the traffic light 117 associated with the light controller 102 can have different traffic signals directed towards all the roads leading to the intersection 101. The different signals may comprise a Red light, a Yellow light, and a Green light. As mentioned, the sensor (s) 206 may be installed to capture objects moving across the roads. The sensor(s) 206 used may include, but are not limited to, optical sensors such as fish-eye camera mentioned above, Closed Circuit Television (CCTV) camera and Infrared camera. Further, sensor(s) 206 can include, but not limited to induction loops, Light Detection and Ranging (LIDAR), radar/microwave, weather sensors, motion sensors, audio sensors, pneumatic road tubes, magnetic sensors, piezoelectric cable, and weigh-in motion sensor, which may also be used in combination with the optical sensor(s) or alone.

The memory 208 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 208 may comprise computer-readable instructions, which when executed by the processor 202, cause the light controller 102 to perform a zone-based control of the traffic at the intersection 101. These functionalities will be further described below with reference to FIG. 4.

Figure 3:
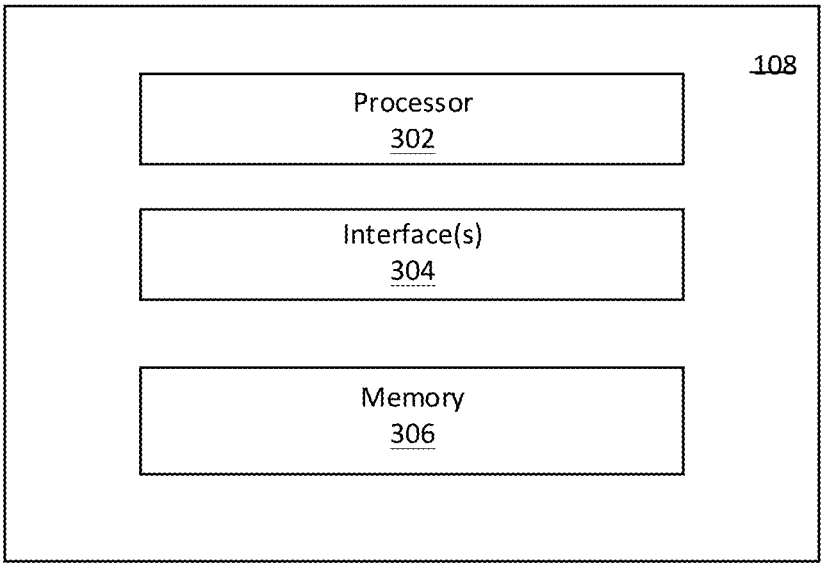
FIG. 3 illustrates a block diagram showing different components of a centralized traffic control system of the system of FIG. 1.

FIG. 3 illustrates a block diagram showing different components of a centralized traffic control system of the system of FIG. 1. The centralized traffic control system 108 can also be referred to as the traffic control system 108.

The traffic control system 108 can comprise one or more processors such as a processor 302, interface(s) 304 and one or more memories such as a memory 306. The processor 302 may execute an algorithm stored in the memory 306 for zone-based traffic controlling, as will be described below. The processor 302 may also be configured to decode and execute any instructions received from one or more other electronic devices or server(s). The processor 302 may include one or more general purpose processors (e.g., INTEL® or Advanced Micro Devices® (AMD) microprocessors, ARM) and/or one or more special purpose processors (e.g., digital signal processors or Xilinx® System On Chip (SOC) Field Programmable Gate Array (FPGA) processor). The processor 302 may be configured to execute one or more computer-readable program instructions, such as program instructions to carry out any of the functions described in this description.

The interface(s) 304 may assist an operator in interacting with the traffic control system 108. The interface(s) 304 of the traffic control system 108 may be used instead of or in addition to the graphical user interface 110 that is centrally accessible by operators or may be the same as the graphical user interface 110. The interface(s) 304 either accept an input from the operator or provide an output to the operator, or may perform both the actions. The interface(s) 304 may either be a Command Line Interface (CLI), Graphical User Interface (GUI), voice interface, and/or any other user interface known in the art or to be developed.

The memory 306 may include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions.

The memory 306 may comprise computer-readable instructions, which when executed by the processor 302, cause the traffic control system 108 to designate zones and conditions for performing a zone-based control of the traffic at the intersection 101. These functionalities will be further described below with reference to FIG. 6.

Having described an example system and example components of one or more elements thereof with reference to FIGS. 1-3, the disclosure now turns to the description of examples for zone-based traffic control.

Figure 4:
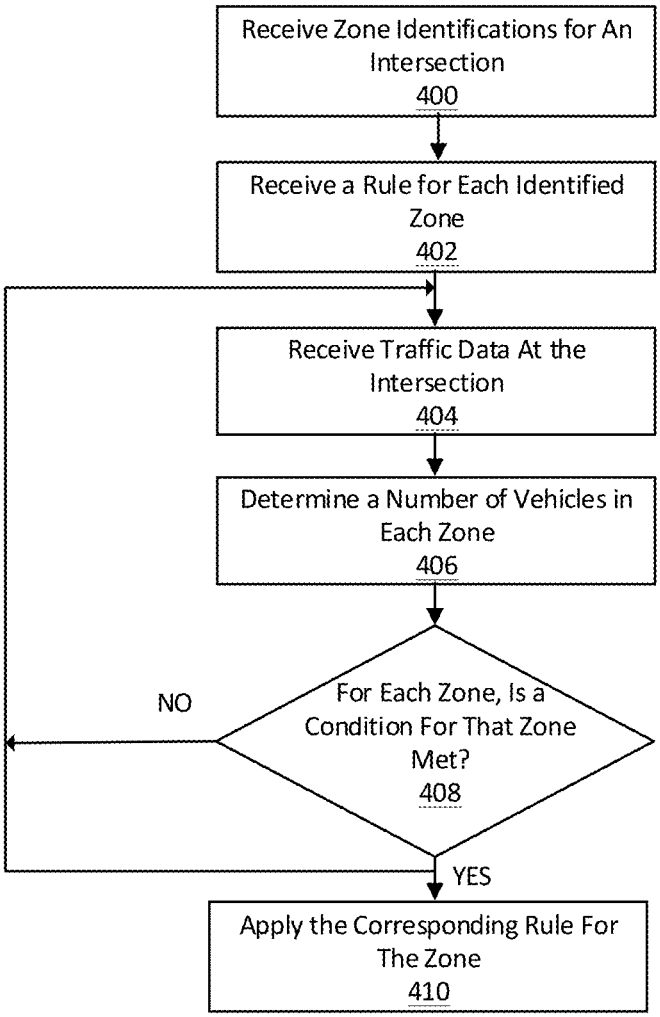
FIG. 4 illustrates a method of zone-based traffic control.

FIG. 4 illustrates a method of zone-based traffic control. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed example embodiments.

Furthermore, FIG. 4 will be described from the perspective of the light controller 102 and with reference to FIGS. 1-3. However, those having ordinary skill in the art would readily appreciate that the functionalities described with reference to FIG. 4 are carried out when the processor 202 of the light controller 102 executes one or more computer-readable instructions/programs/modules stored on the memory 208.

At step 400, the light controller 102 may receive zone identifications for the intersection 101. Each zone can be identified by having a specified perimeter in which, a number of objects (vehicles) are to be detected, as will be described below. Furthermore and as will be described below with reference to FIG. 6, the zones can be identified via the graphical user interface 110 of the centralized traffic control system 108.

Figure 5:
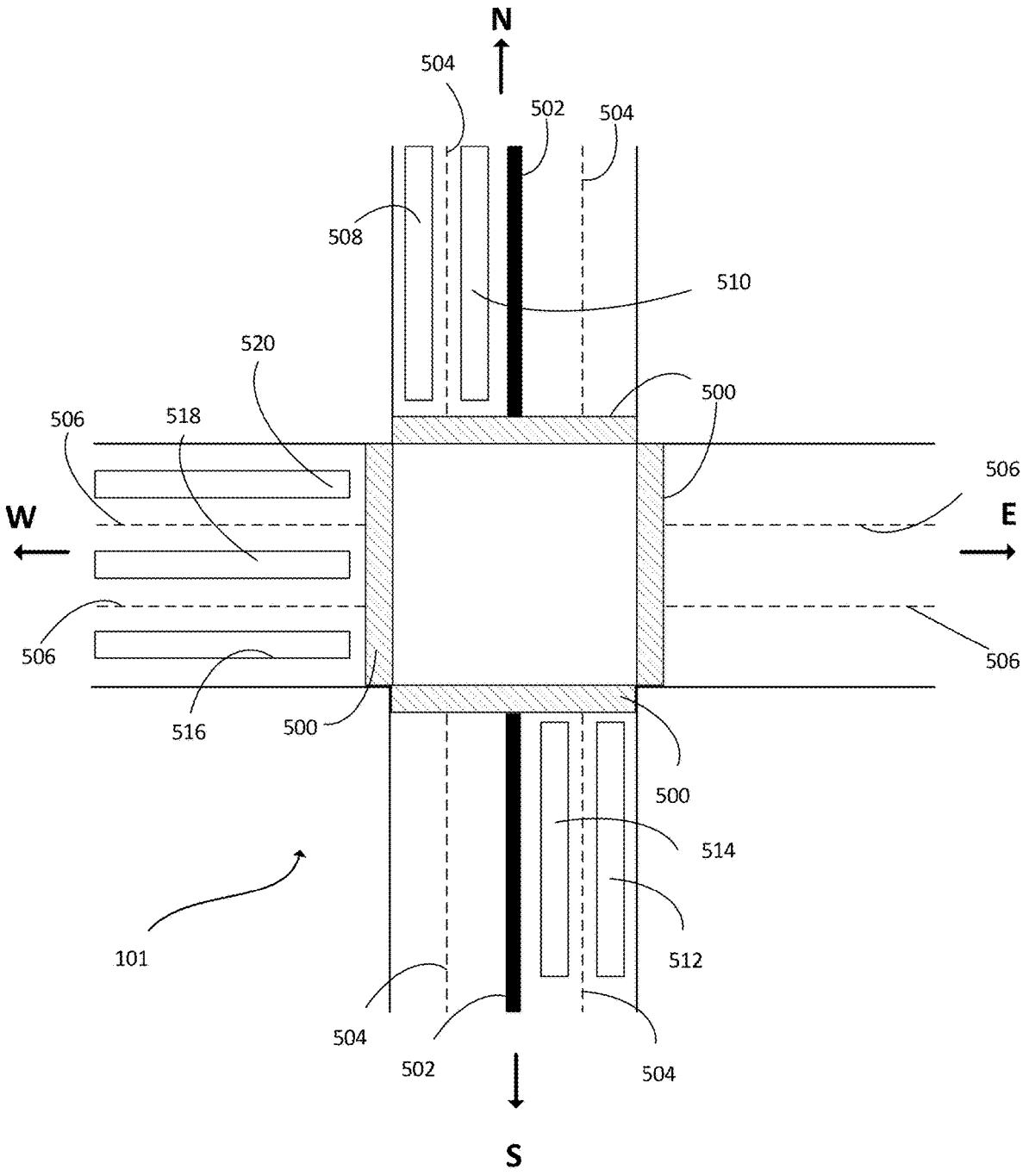
FIG. 5 illustrates an example of identified zones at an intersection.

FIG. 5 illustrates an example of identified zones at an intersection. In the example of intersection 101 shown in FIG. 5, the N-S(North-South) bound direction may be a two-way street while the W-E (West-East) bound direction may be a one way street in the West to East direction. The intersection 101 has crosswalk markings 500 and solid lines 502 separating the two directions on the N-S bound street. Dashed lines 504 may separate the lanes in each direction on the N-S bound street. Dashed lines 506 may separate the lanes in the one-way W-E bound street.

As shown in FIG. 5, the directions from which traffic (vehicles) approach the intersection 101, can be divided into identified zones such as zones 508, 510, 512, 514, 516, 518 and 520. The zone 508 may be for the vehicles approaching the intersection 101 from the north and traveling south bound on the N-S bound street. The zone 510 may be for vehicles approaching the intersection 101 from the north and intending to make a left turn onto the W-E bound street. The zone 512 may be for vehicles approaching the intersection 101 from the south and intending to make a right turn onto the one-way W-E bound street. The zone 514 may be for vehicles approaching the intersection 101 from the south and intending to travel north on the N-S bound street. The zone 516 may be for vehicles approaching the intersection 101 from the west and intending to make a right turn onto the N-S bound street to travel south. The zone 518 may be for vehicles approaching the intersection 101 from the west and intending to move east on the W-E bound street. Finally, the zone 520 may be for vehicles approaching the intersection 101 from the west and intending to make a left turn on the N-S bound street to travel north.

Referring back to FIG. 4, at step 402, the light controller 102 may receive a rule for each identified zone. A rule can specify a triggering condition for the corresponding zone, where the triggering condition can be a threshold number of vehicles in a given zone. For example, the rule for the zone 508 can be that when the light controller 102 detects the presence of 5 vehicles (this can be a triggering condition) therein then the corresponding traffic light 117 is to be switched to green to let the vehicles pass through the intersection 101 and travel south on the N-S street. As another example, the rule for the zone 510 can be that when the light controller 102 detects the presence of 8 vehicles (this can be a triggering condition) therein then the corresponding traffic light 117 is to be switched to green to let the vehicles pass through the intersection 101 and make a left turn onto the W-E bound street to travel east. Similar rules may be established for every other identified zone at the intersection 101.

At step 404, the light controller 102 may receive traffic data of current traffic conditions at the intersection 101. The light controller 102 may receive the traffic data from one or more smart traffic cameras 103 at the intersection 101 and/or from the sensors 206 associated with the light controller 102. The traffic data may be video and/or image data.

At step 406, the light controller 102 determines a number of vehicles in each zone at the intersection 101 using the received video data. The determination of the number of vehicles may be based on any known or to be developed image and video processing methods for detecting/identifying objects in received video/image data.

At step 408 and for each identified zone, the light controller 102 may determine if a condition for the rule corresponding to each identified zone is met. In one example, the condition may be a threshold number of vehicles, the detection of which triggers a changing of the light for the corresponding zone. In the examples described above, for the zone 508, the rule is that a detection of 5 vehicles triggers the light controller 102 to cause the traffic light 117 to change the traffic light for the zone 502 to green to let the detected vehicles in zone 502 pass through. Accordingly, the condition for the zone 502 is the detection of 5 vehicles.

If, for a given zone, the light controller 102 determines that the corresponding condition is met, then at step 410, the light controller 102 adjusts the lighting of the traffic light 117 (changes the lighting at the traffic light 117 by sending instructions to the traffic light 117 to change phase(s)/color (s)) to implement the corresponding rule (e.g., switch the corresponding light to green). In other words, at step 410, the light controller 102 applies a corresponding rule for any identified zone, the condition for which is detected at step 408.

However, if at step 408, the light controller 102 determines that the corresponding condition for a given zone is not detected, the light controller repeats steps 404-408 until the corresponding condition is met.

Examples described above with reference to FIG. 4 are based on the assumption that for given zone, all that is taken into consideration by the light controller 102 is the number of vehicles detected at that particular zone. However, inventive concepts are not limited thereto. For example, for any given zone, the corresponding rule not only depends on the number of vehicles detected at that zone but also on the number of vehicles detected at other zones and the status of the traffic light for such other zones. For example, the rule for zone 508 may be that once 5 vehicles are detected in the zone 508, the corresponding traffic light (traffic signal) is to be switched to green to let the detected vehicles pass through the intersection 101. However, at the same time, the rule for the zone 520 may be that the detection of 6 vehicles should result in switching the traffic light corresponding to the zone 520 to green. If the number of detected vehicles at the zones 508 and 520 are 5 and 6, respectively and simultaneously, then switching their corresponding traffic lights to green simultaneously would hamper the flow of traffic through the intersection 101. Accordingly, the rules for each zone may take into consideration the current condition at one or more additional zones in addition to the detection of the condition at that particular zone. For example, the rule for the zone 508 may be such that if the number of vehicles detected at the zone 508 is equal to 5 and the light corresponding to the zone 520 is not green then the light controller 102 is to switch the traffic light for the zone 508 to green. In another example, the rule for the zone 508 may be such that if the number of vehicles detected at the zone 508 is equal to 5 and the number of vehicles at the zone 520 is less than 2 then the light controller 102 is to switch the traffic light for the zone 508 to green.

Accordingly, the condition detected at step 408 includes not only the number of vehicles detected in a particular zone but also traffic light condition(s) and/or any other condition (s) such as the number of detected vehicles corresponding to one or more additional zones, which have to be met before the rule for the particular zone is implemented.

In another example, the rule for a given zone may also depend on the type of vehicles detected in the zone. For example, the rule for the zone 508 may be such that if 8 cars are detected (and/or the traffic light of the zone 520 is not green), then the traffic light for the zone 508 is to be switched to green. However, the same rule for zone 508 may be such that if 2 heaving duty trucks are detected in the zone 508 (and/or the traffic light of the zone 520 is not green), then the traffic light for the zone 508 is to be switched to be green).

Accordingly, at step 406, the light controller 102 not only determines the number of vehicles at a given zone but also determines a type of the vehicles at the given zone for determining whether to apply the rule for the particular zone or not.

Examples of vehicle types (object types) include but are not limited to, cars, trucks, bicycles, motor cycles, etc. Furthermore, cars, trucks, buses and bikes can further be broken down into sub-categories. For example, cars can be categorized into sedans, vans, SUVs, etc. Trucks can be categorized into light trucks such as pickup trucks, medium trucks such as box trucks or fire trucks, heavy duty trucks such as garbage trucks, crane movers, 18-wheelers, etc.

Having described the zone-based traffic control implemented by the light controller 102, the disclosure now turns to a process for identifying zones and setting corresponding rules.

Figure 6:
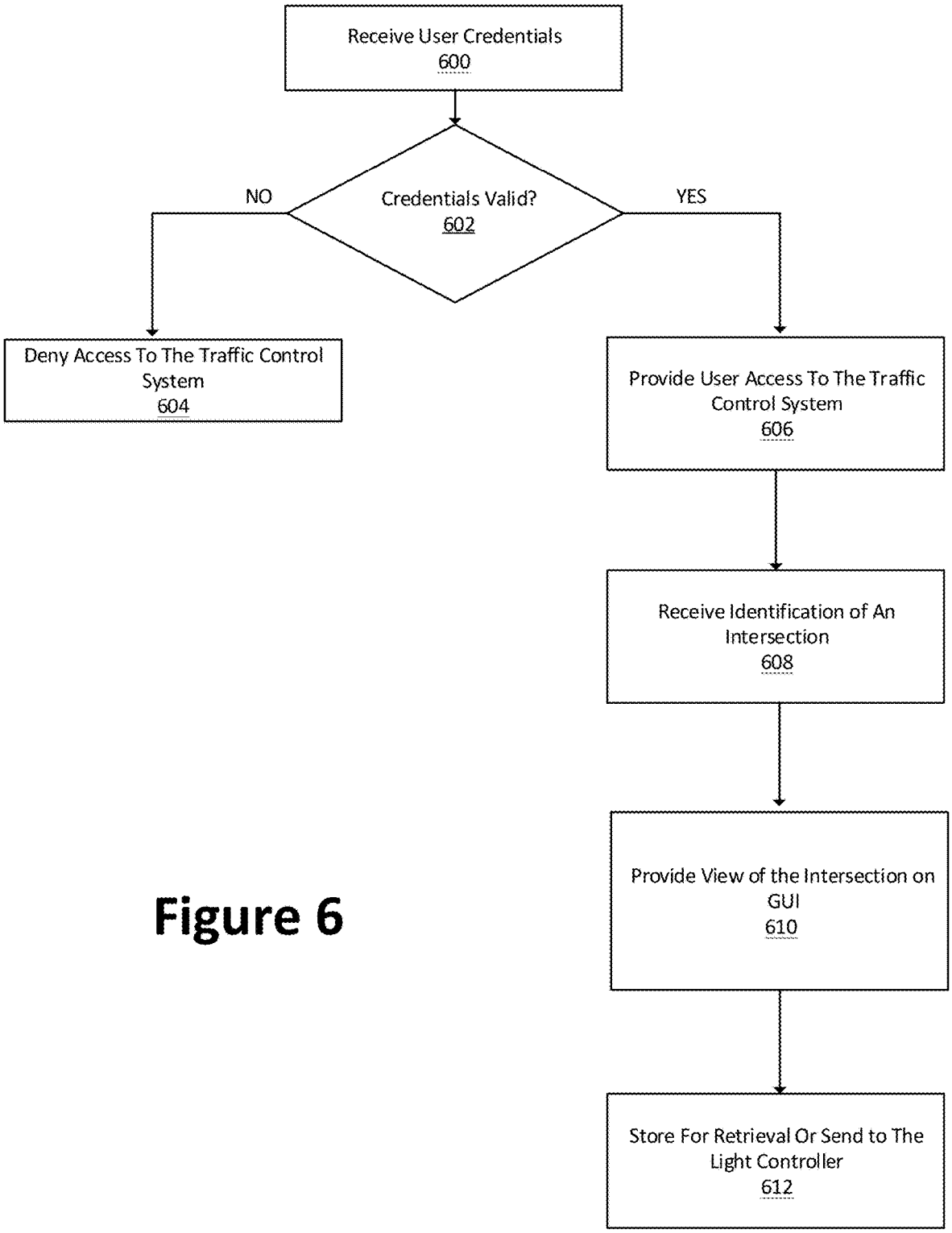
FIG. 6 illustrates a method of zone identification and rule setting.

FIG. 6 illustrates a method of zone identification and rule setting. One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed example embodiments.

Furthermore, FIG. 6 will be described from the perspective of the traffic control system 108 and with reference to FIGS. 1-5. However, those having ordinary skill in the art would readily appreciate that the functionalities described with reference to FIG. 6 are carried out when the processor 302 of the traffic control system 108 executes one or more computer-readable instructions/programs/modules stored on the memory 306.

At step 600, the traffic control system 108 receives, via the graphical user interface 110, credentials of an operator (a user) requesting access to the traffic control system 108 for identifying zones and specifying traffic control rules for the intersection 101.

At step 602, the traffic control system 108 determines if the credentials are valid. If they are not, then at step 604, the traffic control system 108 rejects the operator's request.

However, if at step 602, the traffic control system 108 determines that the credentials are valid, then at step 606, the traffic control system 108 provides the operator with access to the traffic control system 108 via the graphical user interface 110.

Then at step 608, the traffic control system 108 receives an identifier of an intersection such as the intersection 101.

Then at step 610, the traffic control system 108 provides the view of the intersection 101 to the operator on the graphical user interface 110 (GUI 110).

Figure 7:
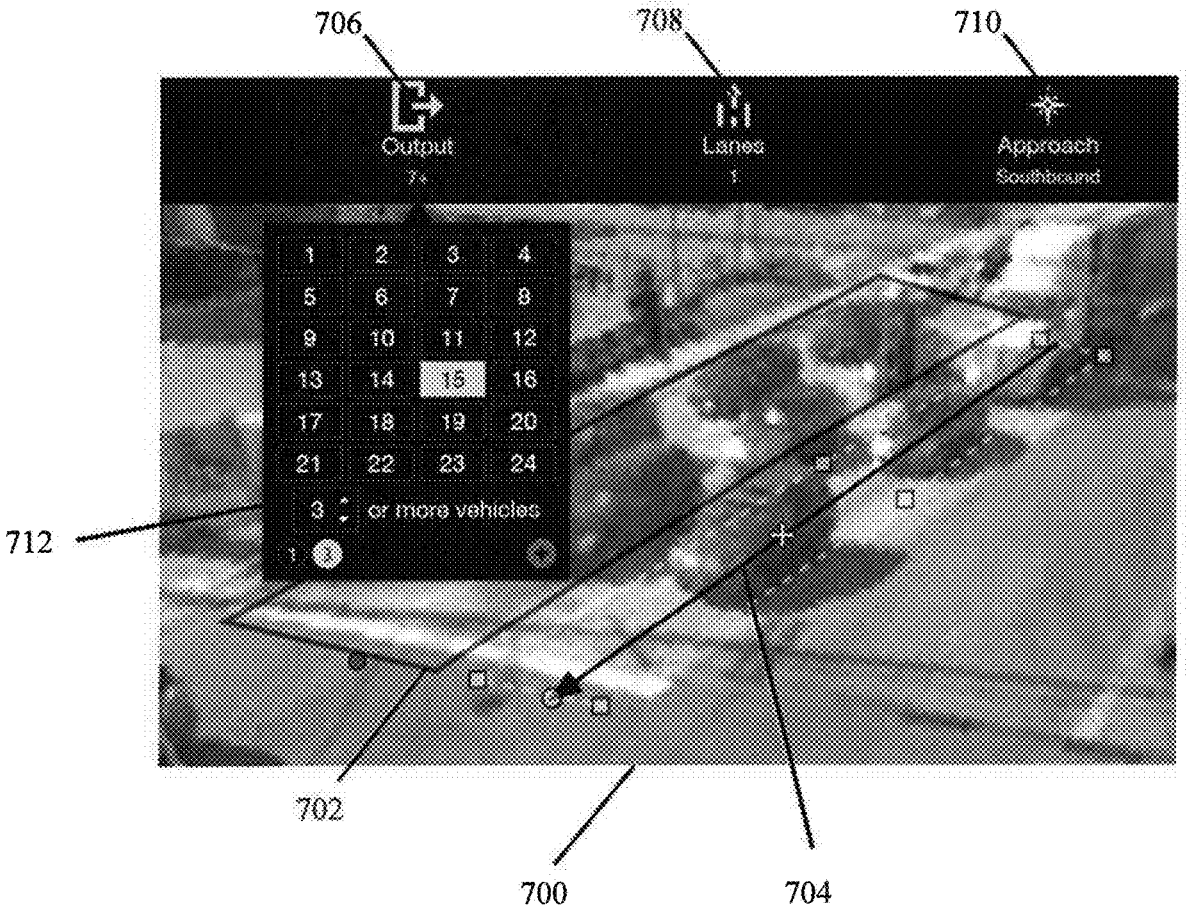
FIG. 7 illustrates a snap shot of the view of an intersection on a graphical user interface.

FIG. 7 illustrates a snap shot of the view of an intersection on a graphical user interface. Screen 700 provided to the operator on the GUI 110 is a partial view of the intersection 101 (e.g., the N-S bound street with the traffic approaching the intersection 101 from the north side in the example of FIG. 5).

As shown in FIG. 7, the screen 700 shows that the operator has defined perimeters 702 of the 508 and the perimeters 704 of the zone 510. This may be done using graphical instruments available to the operator on the GUI 110 such as object insertion features, etc.

At the top of the screen 700, icons for output 706, lanes 708 and approach 710 are shown. The output 706 corresponds to the traffic light 117 that provides traffic signals for the zone. Output 7 indicated on the screen 700 is one output of the traffic light 117 that provides green, yellow and red signals for traffic in the zone 508. Because the operator is currently defining rules for the zone 508, the perimeters 702 thereof are shown using solid lines while the perimeter 704 of the zone 510 is shown using dashed lines.

The lanes 708 is an identifier of a traffic lane in which the zone 508 is defined, while the approach 710 is the direction in which the traffic in zone 508 is heading after passing through the intersection 101 (e.g., southbound).

The screen 700 also shows a control panel 712, which is used by the operator to set rules and conditions that trigger the rules for the zone 508. In this example, the condition is set to 3 vehicles meaning that the operator has defined for zone 508 a rule where a detection of 3 or more vehicles inside the zone 508 triggers a change in the output 706 (i.e., the corresponding traffic light 117) to a green light.

In one or more examples, the screen 700 can provide the operator with options to make the size of a zone variable depending on a time of day. For example, the size of the zone 508 may be set to be larger at 5 PM rush hour relative to the size of the same at 2 AM when fewer vehicles are passing through the intersection 101 (e.g., at 2 AM, the presence of 2 cars may be sufficient to cause a change in the corresponding traffic light whereas at least 8 cars should be detected during the busy rush hour times to cause the change in the traffic light).

Referring back to FIG. 6, at step 612, the traffic control system 108 receives zone identifications and corresponding rules and conditions thereof for the intersection 101, from the operator via the GUI 110, such as the example identification of the zone 508 and the corresponding rule described above.

Thereafter, at step 614, the traffic control system 108 either stores the identified zone and the corresponding rules/conditions in the memory 306 for retrieval by the light controller 102 or in the alternative sends the identified zones and corresponding rules/conditions to the light controller 102 for implementation per the process described above with reference to FIG. 4.

As indicated above, in one example, the traffic control system 108 and the light controller 102 may be the same, in which case the processes of FIGS. 4 and 6 are performed by the single component acting as both the traffic control system 108 and the light controller 102.

Example embodiments of the present disclosure may be provided as a computer program product, which may include a computer-readable medium tangibly embodying thereon instructions, which may be used to program a computer (or other electronic devices) to perform a process. The computer-readable medium may include, but is not limited to, fixed (hard) drives, magnetic tape, floppy diskettes, optical disks, compact disc read-only memories (CD-ROMs), and magneto-optical disks, semiconductor memories, such as ROMs, random access memories (RAMs), programmable read-only memories (PROMs), erasable PROMs (EPROMs), electrically erasable PROMs (EEPROMs), flash memory, magnetic or optical cards, or other type of media/machine-readable medium suitable for storing electronic instructions (e. g., computer programming code, such as software or firmware).

Moreover, example embodiments of the present disclosure may also be downloaded as one or more computer program products, wherein the program may be transferred from a remote computer to a requesting computer by way of data signals embodied in a carrier wave or other propagation medium via a communication link (e.g., a modem or network connection).

What is claimed is:

1. A device comprising:

memory having computer-readable instructions stored therein; and one or more processors configured to execute the computer-readable instructions to:

receive identification of zones and corresponding rules for a signalized roadway intersection, wherein a perimeter of at least one zone is based on user input at a graphical user interface of a traffic control system that is communicatively coupled to the device; and for each identified zone:

receive traffic data from one or more sensors at the signalized roadway intersection;

detect a number of objects in the zone by performing one or more of image processing or video processing on the received traffic data;

based at least in part on the number of objects detected in the zone, determine if a corresponding condition is met; and upon determining that the corresponding condition is met for the zone, send a corresponding signal to a traffic signal controller to change a traffic signal for the zone.

2. The device of claim 1, wherein the corresponding condition is a threshold number of objects detected in the zone.

3. The device of claim 2, wherein the corresponding condition further includes a type of objects detected in the zone.

4. The device of claim 2, wherein the corresponding condition is further based on a traffic light condition of at least one other zone at the signalized roadway intersection.

5. The device of claim 1, wherein the objects are vehicles.

6. The device of claim 5, wherein the vehicles are one or more of a car, a truck, a bicycle or a motor cycle.

7. The device of claim 1, wherein a size of each zone varies based on a time of day.

8. The device of claim 1, wherein the zones and the corresponding rules are specified via the graphical user interface.

9. The device of claim 1, wherein the device is the traffic signal controller configured to be communicatively coupled to traffic lights at the signalized roadway intersection.

10. One or more computer-readable medium having computer-readable instructions stored thereon, which when executed by one or more processors, cause the one or more processors to:

receive identification of zones and corresponding rules for a traffic intersection, wherein:

a perimeter of at least one zone is based on user input at a graphical user interface of a traffic control system that is communicatively coupled to the one or more processors; and for each identified zone:

receive traffic data from one or more sensors at the traffic intersection;

detect a number of objects in the zone by performing one or more of image processing or video processing on the received traffic data;

based at least in part on the number of objects detected in the zone, determine if a corresponding condition is met; and upon determining that the corresponding condition is met for the zone, send a corresponding signal to a traffic signal controller to change a traffic signal for the zone.

11. The one or more computer-readable medium of claim 10, wherein the corresponding condition includes one or more of a threshold number of objects detected in the zone, a type of objects detected in the zone, and a traffic light condition of at least one other zone at the traffic intersection.

12. The one or more computer-readable medium of claim 10, wherein a size of each zone varies based on a time of day.

13. A method of zone-based traffic controlling, comprising:

receiving identification of zones and corresponding rules for a traffic intersection, wherein:

a perimeter of at least one zone is based on user input at a graphical user interface of a traffic control system; and for each identified zone:

receiving traffic data from one or more sensors at the traffic intersection;

detecting a number of objects in the zone by performing one or more of image processing or video processing on the received traffic data;

based at least in part on the number of objects detected in the zone, determining if a corresponding condition is met; and upon determining that the corresponding condition is met for the zone, sending a corresponding signal to a traffic signal controller to change a traffic signal for the zone.

14. The method of claim 13, wherein the corresponding condition includes one or more of a threshold number of objects detected in the zone, a type of objects detected in the zone, and a traffic light condition of at least one other zone at the traffic intersection.

15. The method of claim 13, wherein a size of each zone varies based on a time of day.

* * * * *